United States Patent [19]

Monks

[11] Patent Number: 5,061,116

[45] Date of Patent: Oct. 29, 1991

[54] REINFORCED STRUCTURAL ELEMENTS

[75] Inventor: David W. Monks, Hathersage, England

[73] Assignee: Hodkins & Jones (Sheffield) Limited, England

[21] Appl. No.: 480,307

[22] Filed: Feb. 15, 1990

[30] Foreign Application Priority Data

Feb. 18, 1989 [GB] United Kingdom ..... 8903741

[51] Int. Cl.[5] ..... E02B 11/00; E01C 11/22

[52] U.S. Cl. ..... 405/43; 404/4; 405/118

[58] Field of Search ..... 405/36, 43, 118, 119, 405/155; 404/2, 3, 4, 5

[56] References Cited

U.S. PATENT DOCUMENTS

| | | | |
|---|---|---|---|
| 3,465,654 | 9/1969 | Fox | 404/4 |
| 4,106,300 | 8/1978 | McNeill | 405/155 |
| 4,498,807 | 2/1985 | Kirkpatrick et al. | 405/43 |
| 4,553,874 | 11/1985 | Thomann et al. | 404/4 |
| 4,640,643 | 2/1987 | Williams | 404/4 |
| 4,787,773 | 11/1988 | Kehler | 405/118 |
| 4,878,782 | 11/1989 | Beattie et al. | 405/119 |

FOREIGN PATENT DOCUMENTS

| | | | |
|---|---|---|---|
| 1491703 | 7/1967 | France | 405/119 |
| 2530693 | 1/1984 | France | 404/2 |
| 1591332 | 6/1981 | United Kingdom | 404/2 |

*Primary Examiner*—David H. Corbin

*Attorney, Agent, or Firm*—Fields, Lewis, Pittenger & Rost

[57] ABSTRACT

A channel section is of generally U-shaped cross-section and is made from glass fibre reinforced concrete. The section can be thin and light and easily man-handled. In order to provide the section with sufficient rigidity during the setting of a concrete back fill around the section, a framework of reinforcing bars is provided spaced from the reinforced concrete channel member by tie bars. The reinforcing bars and tie bars form a rigid composite structure with the fibre reinforced concrete member which keeps the member rigid while the concrete back fill is drying and which forms a reinforcing structure in the concrete after drying.

17 Claims, 4 Drawing Sheets

REINFORCED STRUCTURAL ELEMENTS

BACKGROUND TO THE INVENTION

1. Field of the Invention

The invention relates to reinforced structural elements including a member of fibre reinforced material. Examples of such fibre reinforced materials are glass fibre reinforced concrete or glass fibre reinforced gypsum, or gypsum or concrete reinforced with stainless steel fibres.

The use of such fibre reinforced materials is advantageous in that the strength and wear resistance of such materials are superior to unreinforced materials. This allows the dimensions of structural elements formed from such materials to be thinner and lighter than similar elements made of unreinforced materials. Further, it allows elements to be constructed from such materials which, because of weight and size considerations, could not be constructed from unreinforced materials.

2. Brief Review of the Prior Art

An example of this is a water drainage channel. Such channels have conventionally been made of unreinforced concrete and are formed of sections laid end to end and embedded in a concrete surround. Unreinforced concrete channel sections are necessarily thick and heavy and require mechanical lifting gear to handle them. In principle, channel sections of, say, glass reinforced concrete, could be made sufficiently thin and light to be handled by without mechanical lifting gear.

However, when used with a concrete surround, fibre reinforced materials such as glass fibre reinforced concrete can have the disadvantage that they flex and bend and plainly this is unacceptable. It has been proposed, in order to overcome this problem, to make such structural members with two spaced layers of glass fibre reinforced material with a void between the layers filled with an expanded plastics material, such as expanded polystyrene. It has been found, however, that such composite members are liable to fail and for this reason, in some applications, the use has been banned.

SUMMARY OF THE INVENTION

According to a first aspect of the invention, there is provided a structural element comprising a member of fibre reinforced material, one surface of said member having one or more metal reinforcing bars connected thereto but spaced therefrom for anchoring in concrete and maintaining the member rigid during such anchorage.

Thus, the use of the sPaced reinforcing bar or bars allows the structural element to be thin and light but at the same time prevents its flexure when set in concrete. In essence, prior to setting in concrete, the metal bar forms a rigid composite structure with the member and, after setting, the bar reinforces the concrete.

According to a second aspect of the invention, there is provided a drainage channel comPrising an elongate member of generally U-shaped cross-section and formed of fibre reinforced concrete, an interior surface of said elongate member defining a passage for the drainage of liquid, an exterior surface of said channel, spacer means provided on said exterior surface of said channel, and metal reinforcing bars connected to said spacer means and held by said spacer means at a position spaced from said exterior surface to provide an anchor for concrete in which the channel is set.

According to a third aspect of the invention, there is provided a method of manufacturing of reinforced structural element comprising connecting one or more spacers to a metal reinforcing bar, preparing a member of a fibre reinforced material and, before the fibre reinforced material is dry, connecting the spacer bars to the member.

According to a fourth aspect of the invention there is provided a method of manufacturing a drainage channel comprising forming from fibre reinforced concrete an elongate member of U-shaped cross-section with an interior surface defining a passage for the drainage of liquid and an exterior surface and connecting to said exterior surface a plurality of reinforcing bars at positions spaced from said exterior surface.

The following is a more detailed description of one embodiment of the invention, by way of example, reference being made to the accompanying drawings, in which:

DESCRIPTION OF THE PREFERRED EMBODIMENTS

Figure 1:
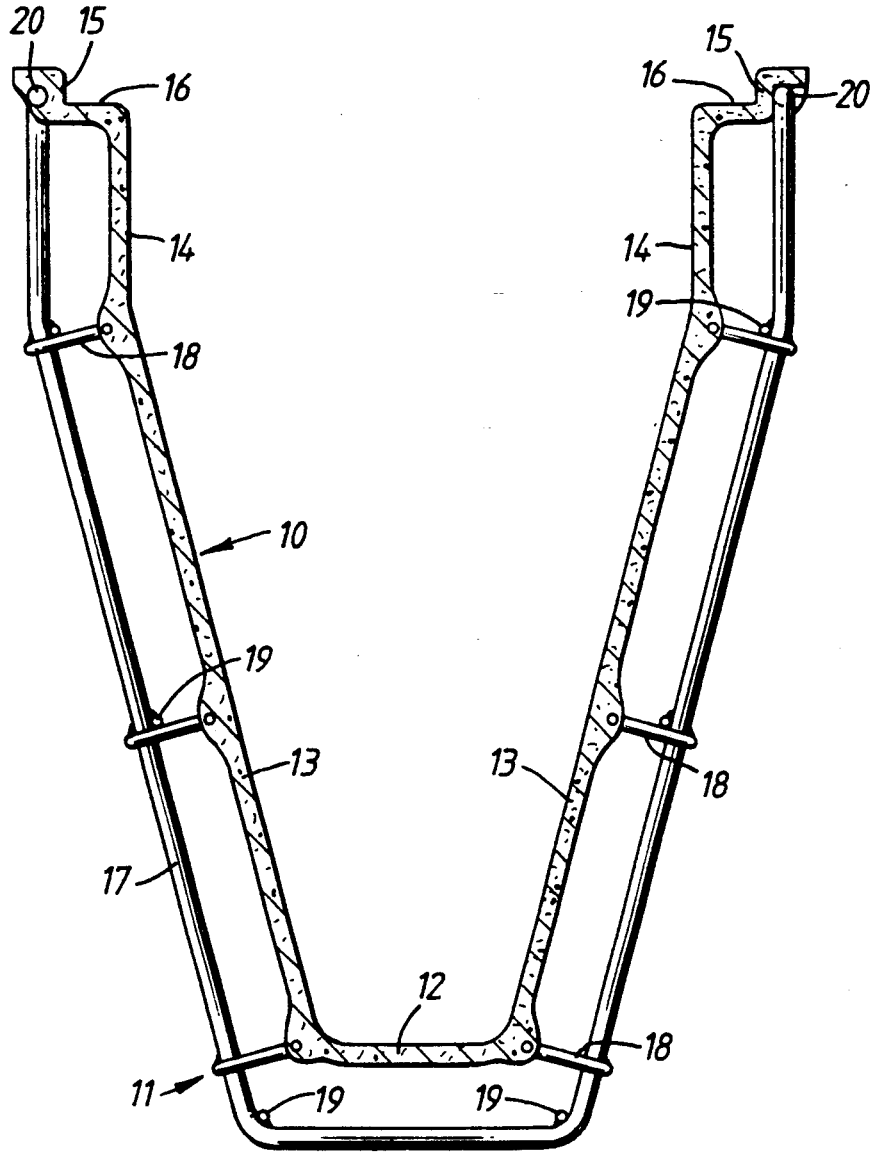
FIG. 1 is a cross-section through a first form of U-shaped channel section of glass fibre reinforced concrete.

The channel section shown in the drawings is one of a number of such sections which are laid end to end to form a drainage channel. The open upper end of the channel is covered by an end to end series of perforate covers which provide a load-bearing surface while allowing water to drain through the perforations into the channel.

Referring now to FIG. 1, the first form of channel section is formed in two main parts, a member 10 of glass fibre reinforced concrete and a framework of reinforcing bars 11 connected to the concrete member 10.

The glass fibre reinforced member is of generally U-shaped cross-section with a flat base 12 from which extend diverging lower side walls 13. Parallel upper side walls 14 extend from the lower side walls 13. Outwardly extending stepped flanges 15 provide the upper free ends of the upper side walls 14. The steps 16 in the flanges 15 are for receiving the edges of a cover (not shown).

Since the member 10 is made of glass fibre reinforced concrete, it is light in weight and thin in dimensions as compared with a member of unreinforced concrete.

Figure 2:
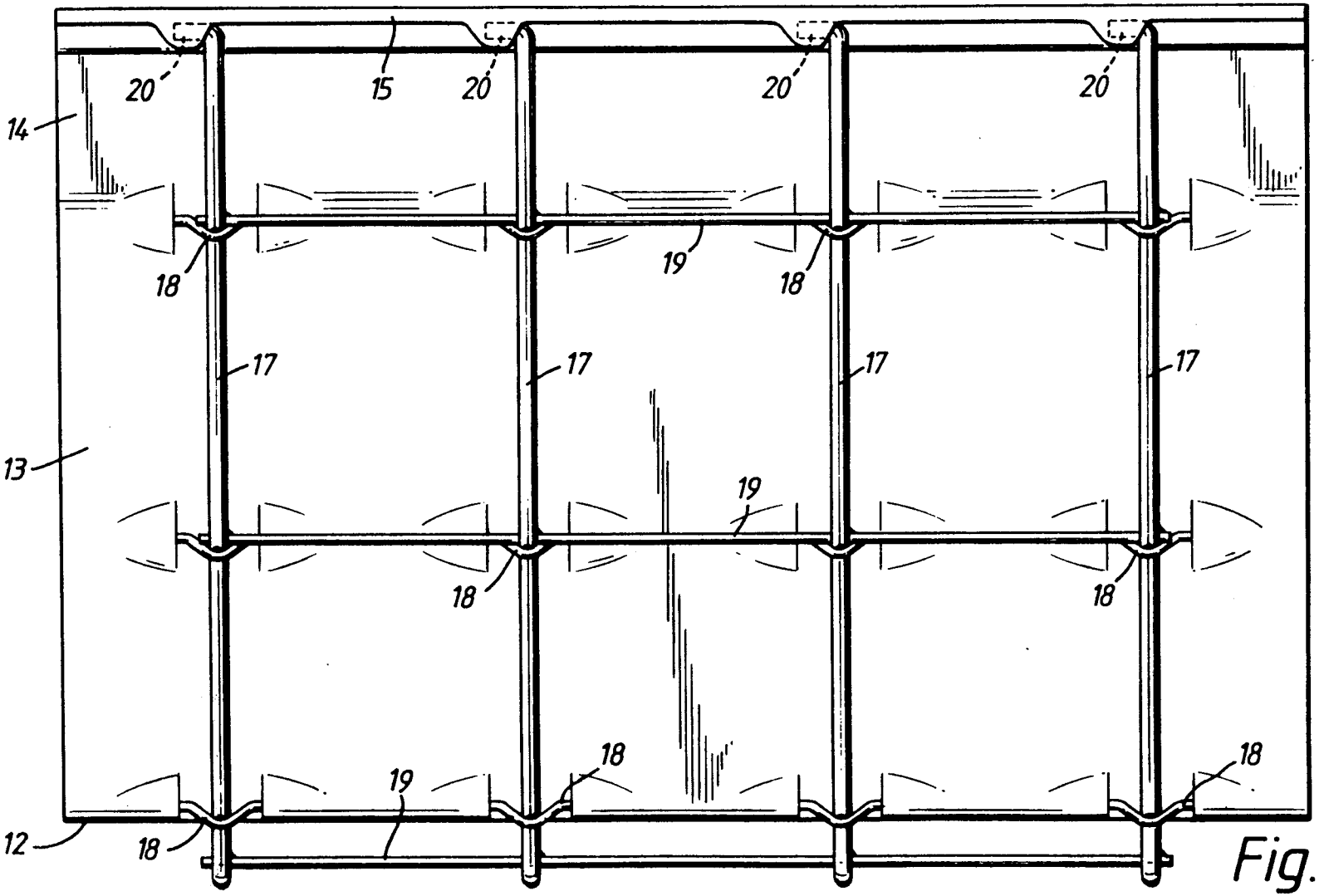
FIG. 2 is a side elevation of the channel section of FIG. 1.

Referring now to FIGS. 1 and 2, the reinforcing framework 11 comprises four U-shaped reinforcing bars 17, tie bars 18 and spacer bars 19. All these bars may be of circular cross-section steel. The steel may be galvanised to resist corrosion. Alternatively, the bars may be of any other suitable material including phospher bronze or other alloys.

Each reinforcing bar 17 is of similar shape to the cross-section of the reinforced concrete member 10 but of increased dimension. As best seen in FIG. 2, the free ends of each reinforcing bar 17 are provided with portions 20 which extend parallel to the length of the channel section. On each reinforcing bar, these end portions 20 face opposite directions and are connected to respective flanges 15 towards the outer edges of those flanges 15.

The tie bars 18 are of generally V-shape (see FIG. 3) with outwardly turned ends 21. Six such tie bars 18 are used to connect each of the four reinforcing bars 17 to the concrete member 10. Of course, a greater or lesser number may be used as required.

Figure 3:
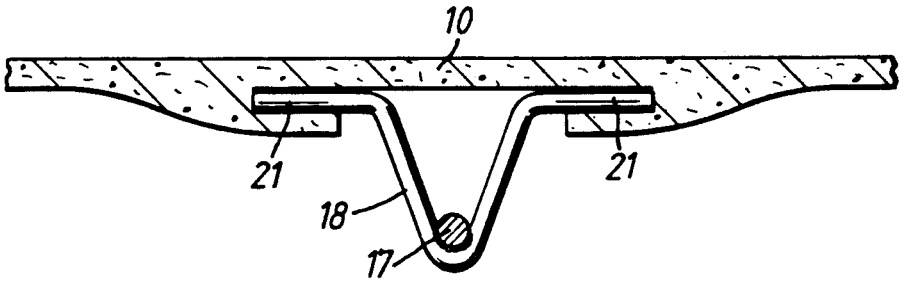
FIG. 3 is a detail showing the connection of a tie bar to the glass fibre reinforced concrete of the channel section.

Each reinforcing bar 17 is welded in the angle between the limbs of the six tie bars 18, which are arranged around the reinforcing bar 17 as shown in FIG. 1. The end portions 17 of the tie bars 18 are connected to the concrete member 10, as shown in FIG. 3.

In this way, the reinforcing bars 17 are rigidly connected to the concrete member and form, with the concrete member, a composite structural element.

The four reinforcing bars 17 are interconnected by the spacer bars 19. In all, six such spacer bars are used at spaced intervals around the reinforcing bars, as seen in FIGS. 1 and 2. The spacer bars 19 extend parallel to the length of the channel section and are welded to the reinforcing bars 17.

Figure 4:
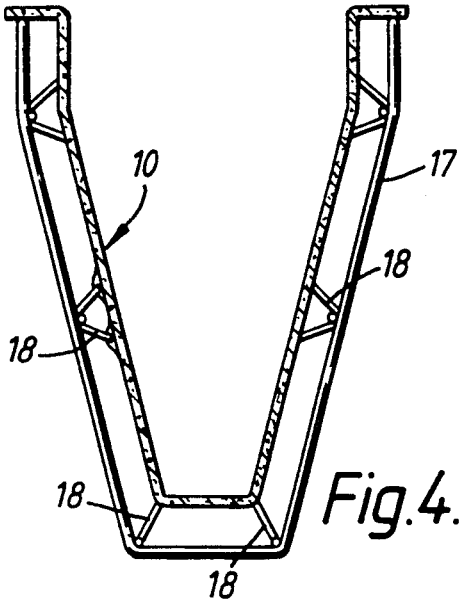
FIG. 4 is a similar view to FIG. 1 but showing tie bars connected to the glass fibre reinforced concrete member in a different orientation.
Figure 5:
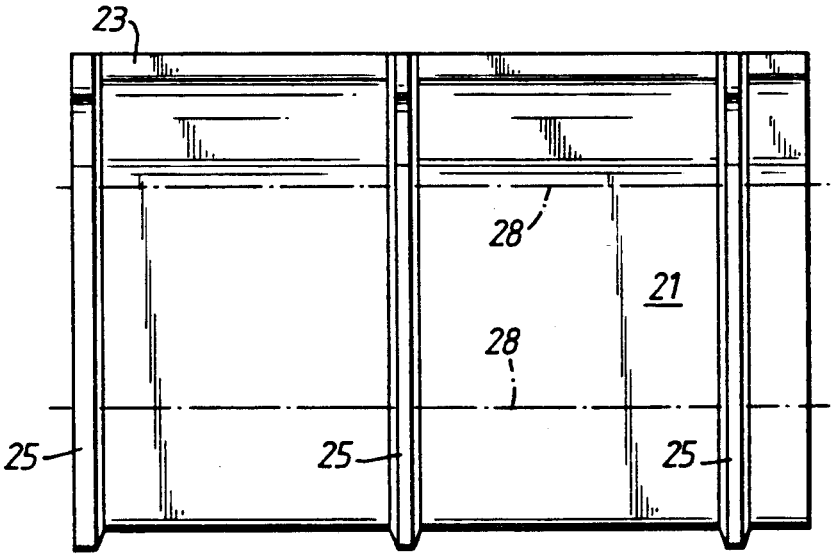
FIG. 5 is a side elevation of a second form of U-shaped channel section of glass fibre reinforced concrete.
Figure 6:
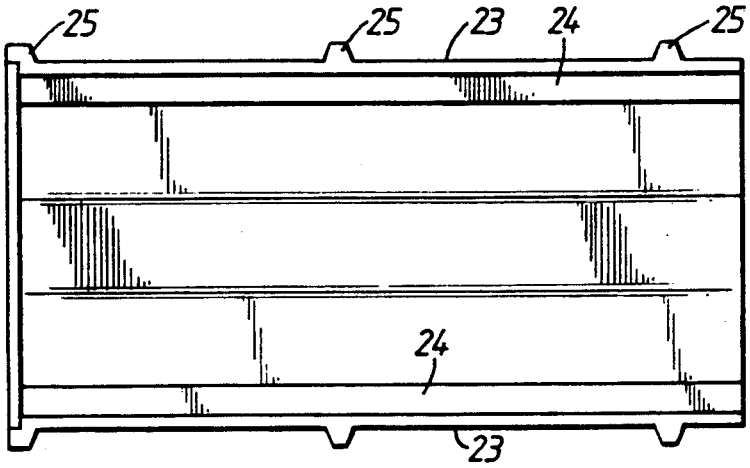
FIG. 6 is a plan view of the channel section of FIG. 5.
Figure 7:
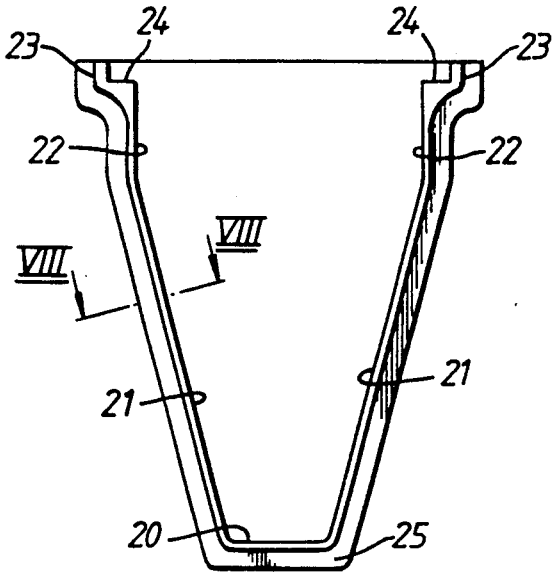
FIG. 7 is an end elevation of the channel section of FIGS. 5 and 6.

As shown in FIG. 1, the tie bars 18 lie in planes generally normal to the cross-section of the channel member 10. However, as shown in FIG. 4, at least some of the tie bars 18 may be turned through 90° so that they lie in planes including the plane of the concrete member 10. This may have the advantage of giving a more rigid structure, since, as will be seen from FIG. 4, the structure approximates to a truss.

In use, a trench is excavated where a channel is required. A plurality of channel sections of the kind described above with a reference to the drawings are then laid end to end and aligned to form a continuous channel. For the purposes of alignment, the channel sections may be provided with interlocking or interconnecting parts (not shown).

Alternatively, as the channel sections are laid end to end to form the channel, they can be connected together by the use of bars which extend between adjacent reinforcing bars 17 on the two sections. As shown in FIG. 3, the outer reinforcing bars 17 are spaced by some distance from the ends of a channel section. It would be possible, however, to arrange for these outer reinforcing bars 17 to be close to the ends of the associated channel section. With such an arrangement, a butting channel sections would have closely adjacent reinforcing bars 17 which could be tied together using wire.

The channel sections described above with reference to the drawings are comparatively light in weight and can be unloaded and positioned without the use of a mechanical lifting device. Their low weight also facilitates their transport.

The bases of the sections are then set in concrete and, once this concrete has dried, the remainder of the trench is filled with concrete. The spacing of the reinforcing bars 17 from the reinforced concrete member 10 is such as to ensure that this concrete fills completely the spaces between the reinforcing bars 17 and the exterior surface of the concrete member 10. The forces generated by the wet concrete, which tend to squeeze the side walls of the concrete member together, are resisted by the framework 10, which thus holds the concrete member rigid while the back fill concrete is setting.

Once set, the framework 11 provides reinforcement for the back fill concrete, so increasing its strength. In addition, it provides a key which ensures a firm connection between the concrete member 10 and the concrete.

The channel sections may be manufactured in the following way.

First, a number of reinforcing bars 17, tie bars 18 and spacer bars 19 are formed to shape from steel bar stock. Four reinforcing bars 17 are then arranged at space intervals along a former and the tie bars 18 and spacer bars 19 welded to them to form the framework 11.

Glass fibre reinforced concrete is then sprayed onto the exterior of a suitably shaped mould to form the reinforced concrete member 10. While this concrete is still wet, the former is brought up to the mould and the ends of the reinforcing bars 17 and the tie bars 18 positioned on the concrete. As seen in FIG. 3, further fibre reinforced concrete is then applied over the ends of the tie bars 18 and over the ends of the reinforcing bars 17 and the structure left to dry. Curing may be natural curing or may involve the use of applied heat. Once cured, the mould and the former are removed to leave a completed channel section.

An alternative method of manufacture, the reinforcing framework 11 may be constructed as above, but the reinforced concrete member 10 formed as follows.

First, glass fibre reinforced concrete is laid over a flat porous sheet. The fibre reinforced concrete is then dewatered and shaped by wrapping around a mould. The manufacture then continues as described above.

This alternative method of manufacture has the advantage of better controlling the thickness of the fibre reinforced concrete member 10.

Referring next to FIGS. 5 to 8, the second form of channel section is of a generally U-shaped cross-section similar to that of the channel section described above with reference to FIG. 1 to 4 and including a flat base 20, diverging lower side walls 21, parallel upper side walls 22 and flanges 23 provided with steps 24 for receiving the edges of a cover (not shown). The channel section is of glass fibre reinforced concrete.

The exterior surface of this channel is provided with three U-shaped ribs 25. Each rib 25 lies in a plane normal to the length of the channel and extends from the upper edge of one flange 23 to the upper edge of the other flange 23 passing, inbetween, over the upper side walls 22, the lower side walls 21 and the base. There is a rib 25 at each end of the channel section and a rib 25 at a position intermediate the ends of the section. Of course, there may only be two ribs 25 or there may be four or more ribs.

Figure 8:
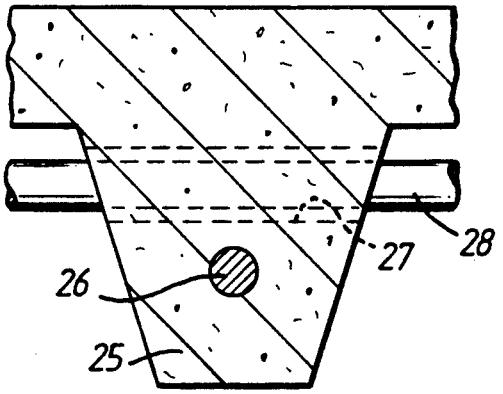
FIG. 8 is a section on the line VIII—VIII of FIG. 7.

As best seen in FIG. 8, each rib 25 is reinforced by a correspondingly shaped cast reinforcement bar 26. As also seen in that Figure and in FIG. 5 each rib 25 is provided with five spaced holes 27 extending through the rib 25 in a direction parallel to the length of the channel and spaced around the rib 25. The holes 27 of the ribs 25 are in register. The use of the holes 27 will be described below.

The second form of drainage channel is manufactured by arranging the reinforcement bars 26 in a suitably shaped mould (not shown). Glass fibre reinforced concrete is then sprayed into the mould to form the channel section. The holes 27 are then formed by, for example, drilling.

In use, a trench is excavated where a channel is required. A plurality of channel sections of the kind described above with reference to FIGS. 5 to 8 are laid end-to-end and aligned to form a continuous channel. For aiding alignment the channel sections may be provided with interlocking or interconnecting parts (as shown).

Next reinforcement bars 28 (see FIG. 1) are inserted through the aligned holes 27 and are wired together to form continuous bars extending generally parallel to the length of the channels and parallel to, but spaced from, one another. This wiring also helps to draw the channel sections together. The channel sections are then set in concrete as described above with reference to FIGS. 1 to 4.

Of course, the bars 28 need not be fitted on site, they could be supplied fitted to the channel sections and then wired together on site. Although four such bars 28 are described, there could be more or less bars as required.

Although the invention has been described above in an exemplary embodiment of a drainage channel, it will be appreciated that it may be applied to other structural elements. For example, it may be applied to permanent shuttering formed by a sheet of reinforced material such as glass fibre reinforced concrete. In this case, a number of reinforcing bars are attached to the member by spacers or are mounted on flanges. When the shuttering is in position, concrete surrounds the bars and the bars form a rigid structure with the fibre reinforced concrete member while the concrete is setting and, once set, provide a reinforcement for the concrete.

It will be appreciated that any reinforced material may be used. For example, the material may be gypsum and the reinforcement need not be glass fibres, it could be stainless steel fibres or other fibres.

I claim:

1. A structural element comprising:

a member of fibre reinforced material which forms a section of water drainage channel of generally U-shaped cross-section including spaced side walls interconnected by a bottom wall and having spaced upper free ends, each said side wall and said bottom wall having an exterior surface; and at least one metal reinforcing bar spaced laterally from said exterior surface of each of said side walls and extending from adjacent said upper free ends to a location adjacent said bottom wall and connected thereto for anchoring said channel in concrete and maintaining said channel rigid during such anchorage.

2. A structural element according to claim 1 wherein:

said at least one reinforcing bar is of generally U-shape and lies in the plane of and extends from said upper free ends around said U-shaped cross-section of said channel and is spaced laterally from said exterior surface thereof; and tie bars connecting said at least one reinforcing bar to said exterior surface of said channel.

3. A structural element according to claim 2 wherein at least two U-shaped reinforcing bars are provided, interconnected by at least one spacer bar extending parallel to the length of the channel.

4. A structural element according to claim 2 wherein the channel includes outwardly extending flanges from upper free ends of the channel, the flanges being connected to respective ends of the at least one U-shaped reinforcing bar.

5. A structural element according to claim 2 wherein each tie bar is of V-shape, with the associated reinforcing bar connected in the angle of the V and the two free ends of the limbs of the V connected to the channel member.

6. A structural element according to claim 5 wherein at least one of the V-shape tie bars lies in a plane normal to the plane of the U cross-section of the channel member.

7. A structural element according to claim 5 where at least one of the V-shape tie bars lies in the plane of the U cross-section of the channel member.

8. A drainage channel comprising:

an elongate member of generally U-shaped cross-section, with spaced generally vertical side walls interconnected by a bottom wall and having spaced upper free ends and formed of fibre reinforced concrete having an interior surface defining a passage for the drainage of liquid and an exterior surface;

spacer means provided on said exterior surface of said member; and metal reinforcing bars connected to said spacer means and held by said spacer means at a position spaced laterally from said exterior surface of each of said side walls extending from said upper free ends to a location adjacent said bottom wall to provide an anchor for concrete in which said channel is set.

9. A drainage channel according to claim 8 wherein said spacer means comprises a plurality of tie bars having ends thereof set in said fibre reinforced concrete and ends remote from said member connected to said reinforcing bars.

10. A drainage channel according to claim 9 wherein said reinforcing bars are U-shaped and lie in respective spaced planes including the planes of the U-shaped cross-section of the elongate member.

11. A drainage channel according to claim 8 wherein said spacer means comprises a plurality of spaced ribs provided on said exterior surface of said elongate member, each rib being generally U-shaped and lying in a plane normal to the length of said channel, said reinforcing bars being carried by and extending between said ribs.

12. A drainage channel according to claim 11 wherein said reinforcing bars extend generally parallel to the length of the channel.

13. A structural element comprising:

a member of fibre reinforced material which forms a section of water drainage channel of generally U-shaped cross-section including spaced side walls interconnected by a bottom wall and having spaced upper free ends, each said side wall and said bottom wall having an exterior surface; and at least one metal reinforcing bar spaced laterally from said exterior surface of each of said side walls and extending generally parallel to the length of the channel at a position intermediate said upper free ends and said bottom wall and connected thereto for anchoring said channel in concrete and maintaining said channel rigid during such anchorage.

14. A structural element according to claim 13 wherein a plurality of reinforcing bars are provided, each reinforcing bar extending generally parallel to the length of said side walls of said channel in generally vertically spaced parallel relationship to one another.

15. A structural element according to claim 14 wherein said exterior surface of the channel is provided with at least two ribs lying in respective planes normal to the length of said channel, said reinforcing bars extending between, and being carried by, said ribs.

16. A structural element according to claim 15 wherein each rib is reinforced by an associated reinforcing bar.

17. A structural element according to claim 15 wherein each rib is generally U-shaped extending around the channel between the open ends of the U-shaped cross-section.

* * * * *